US009202623B2

(12) United States Patent
Hatch

(10) Patent No.: US 9,202,623 B2
(45) Date of Patent: Dec. 1, 2015

(54) COIL SYSTEM AND HOUSING

(71) Applicant: Profire Energy, Inc., Lindon, UT (US)

(72) Inventor: Justin W. Hatch, Springville, UT (US)

(73) Assignee: Profire Energy, Inc, Lindon, UT (US)

( * ) Notice: Subject to any disclaimer, the term of this patent is extended or adjusted under 35 U.S.C. 154(b) by 0 days.

(21) Appl. No.: 13/946,614

(22) Filed: Jul. 19, 2013

(65) Prior Publication Data

US 2014/0022038 A1 Jan. 23, 2014

Related U.S. Application Data

(60) Provisional application No. 61/674,321, filed on Jul. 21, 2012.

(51) Int. Cl.

| | |
|---|---|
| ***H01F 27/02*** | (2006.01) |
| ***H01F 38/12*** | (2006.01) |
| ***H01F 27/29*** | (2006.01) |

(52) U.S. Cl.

CPC ..... *H01F 38/12* (2013.01); *H01F 27/02* (2013.01); *H01F 27/29* (2013.01)

(58) Field of Classification Search

CPC ..... H01F 27/00–27/30
USPC ..... 336/90, 92, 192
IPC ..... H01F 27/29, 27/02
See application file for complete search history.

(56) References Cited

U.S. PATENT DOCUMENTS

| | | | | |
|---|---|---|---|---|
| 5,378,174 | A * | 1/1995 | Brownlie | H01R 13/502 174/652 |
| 6,630,637 | B1 * | 10/2003 | Ward | H01H 9/02 200/17 R |
| 7,193,497 | B2 * | 3/2007 | Yeh et al. | 336/198 |
| 2008/0185801 | A1 * | 8/2008 | Gravlin et al. | 280/47.11 |
| 2012/0244730 | A1 * | 9/2012 | Grimm | H01R 13/447 439/142 |

* cited by examiner

*Primary Examiner* — Tuyen Nguyen
(74) *Attorney, Agent, or Firm* — Clegg, PC; Perry S. Clegg

(57) ABSTRACT

A coil system for a burner management system and coil housing is provided having recessed terminals and a housing lid to cover the terminal recesses for reducing exposure of coil system terminals to air and unwanted contacts.

19 Claims, 5 Drawing Sheets

COIL SYSTEM AND HOUSING

PRIORITY

The present application claims the benefit of U.S. Provisional Patent Application Ser. No. 61/674,321 filed on Jul. 21, 2012, which is incorporated herein by reference in its entirety.

FIELD OF THE INVENTION

The present invention relates to coil housings for coil systems used to initiate combustion or flame in a combustion management system. More specifically, the present invention relates to coil housings for transformer coils used in a combustion management system for oil or gas vessel heating systems.

BACKGROUND

Oil and gas within tanks, or vessels, placed at or near oil and gas wells are commonly heated as part of a preliminary refinement process using heating systems and a combustion management system. The combustion management systems are generally used to heat and monitor a medium drawn through a heating vessel. The combustion or flame used in this process occurs in a combustion chamber near an airplate.

The ability to control combustion or flame ignition is a key feature of combustion management systems. Combustion management systems often rely on an electrical spark to initiate combustion or flame at the combustion chamber. A common method of creating a spark is to use a transformer coil to convert a low voltage power source into a high voltage current capable of arcing between two conductive points; the arcing creating a spark that is used to initiate combustion or a flame.

The transformer coil is typically maintained outside of the combustion chamber and may have wires extending from the transformer coil to an electrode that may be disposed near the situs where the combustion or flame is initiated. Ignition may be controlled using a control box that communicates when a spark should be created at the electrode, to initiate combustion, by controlling power to the transformer coil.

A common feature of a coil system is a coil housing. The coil housing is often used to cover the transformer coil, which helps protect the transformer coil from weather or damage from unwanted contacts and may reduce the risk of personnel coming into contact with high voltage electrical currents.

However, coil housings currently used in combustion management systems have a number of disadvantages. One disadvantage with coil housings currently being used in combustion management systems at oil and gas well sites is the risk of unwanted arcing, particularly between terminals, because of the high voltage generated by the coils. Unwanted arcing is any arcing of current from point to point (e.g., between terminals) other than at the site where the arcing is intended to create the spark for initiating flame (e.g., at the end of the electrode in the combustion chamber). When unwanted arcing occurs, the coil may not transfer current properly. Further, unwanted arcing increases the risk of damage or injury to equipment and personnel.

The risk of unwanted arcing may increase when terminals have more exposure to air. The risk of unwanted arcing may also increase as the distance between the terminals decreases. Coil systems currently being used in connection with combustion management systems may have several terminals which extend outside the coil housing, thus being significantly exposed to air.

Another disadvantage of many coil housings currently being used in connection with combustion management systems is that they may be restricted to larger sizes because of the need to keep the terminals separated by sufficient distance to prevent arcing.

Another disadvantage of many coil housings currently being used in connection with combustion management systems is that the coil systems often must be mounted in a location that is inconvenient for maintenance and repair, as a more accessible location poses a risk of incidental, unwanted arcing with a nearby tool or object. Thus, current transformer coil systems are typically placed in more inconvenient locations to mitigate the risk of unwanted arcing, because the coil housings may not provide adequate protection to the terminals or against other unwanted arcing. However, such locations that protect against contact with external elements are also locations that may be inconvenient or inhibit access to the coil system for maintenance and repair. Additionally, the efficiency of the coil system decreases as the distance between the coil system and the point of spark at the combustion chamber increases.

Another disadvantage of many coil housings currently being used in connection with combustion management systems is that the coil housing may not allow for more than three terminals, thus limiting the function of the coil systems. The location and number of terminals may be limited because certain terminal arrangements increase the risk of unwanted arcing.

Because coil terminals in existing coil systems extend from the coil housings and are exposed to the air, configuring coil systems with the coil terminals disposed closer together or with more than three coils may be challenging and create safety concerns and increased risk of unwanted arcing.

Another disadvantage of coil housings currently being used in connection with combustion management systems is the risk of unwanted arcing during the repair and maintenance of the coil system. When a tool comprising conductive material, such as a metal screwdriver, is brought in close proximity to the coil or coil terminals, the coil is more likely to arc and shock the individual holding the tool because the coil housing does not completely insulate the coil terminals.

It is thus desirable to have a coil system and housing that mitigates the risk of unwanted arcing when a coil is repaired or maintained; that restricts contact with external elements without requiring remote or inconvenient placement of the coil system; and that allows for more freedom in both the number and placement of coil terminals.

SUMMARY OF THE INVENTION

It is an object of the present invention to provide an improved coil system and housing.

According to one aspect of the invention, a coil housing is provided that protects the coil and coil terminals from external elements and unwanted contacts. The coil housing may restrict coil and terminal contact with external elements and thereby reduces the risk of unwanted arcing.

According to another aspect of the invention, a coil housing is provided that is configured for three or more coil terminals.

According to another aspect of the invention, the coil housing provides for coil terminals that are recessed within the coil housing.

According to another aspect of the invention, the coil housing includes a housing lid that may be disposed on the top surface of the coil housing to close the coil terminal recesses and reduce exposure of the terminals to air. According to another aspect of the invention, a coil system is provided wherein the coil housing is comprised of a primary housing and a housing lid, wherein the primary housing and the housing lid may be comprised of non-conductive material. In another aspect of the invention, the primary housing encases a transformer coil.

In another aspect of the invention, the primary housing may further comprise means for securing the coil housing to a surface. The means of securing the coil housing to a surface for mounting may be holes suitable for bolts or screws. The means of securing the coil housing to a mounting surface may also be a clamp or bracket. The means of securing the coil housing to a surface may also be an adhesive material for adhering the coil housing to the mounting surface.

In another aspect of the invention, the primary housing may be configured with access ports that provide access to each of the terminals. The access ports may be comprised of non-conductive material and each port may provide access through the primary housing to the coil terminals. The ports may comprise a chamber or a bored tube. Each port may extend into the primary housing and isolate a specific terminal so that access to a terminal is completely isolated from access to another terminal. There may be an access port to each terminal or only an access port for select terminals. Through the access ports a terminal set screw may be adjusted to tighten or loosen a terminal set bracket, which may be used to secure or unsecure a conductive wire connectable to the respective coil terminal, without creating a risk of unwanted arcing.

In another aspect of the invention, the housing lid may be disposed on the primary housing to cover the access ports and further protect the terminals and the coil. The housing lid may be comprised of a non-conductive material. The housing lid may be rotatably attached to a first side of the primary housing with one or more hinges so that it can be opened and closed to permit or restrict access to the access ports. The housing lid may be secured in a closed position using a clamp or threaded bolt. The housing lid may also be secured by snapping it onto the primary housing using a snap fastener or similar mechanical means for securing the housing lid to the primary housing. The housing lid may restrict or reduce the terminal's exposure to air or other external elements when closed.

In another aspect of the invention, the coil terminals may be further isolated using an insulated encasement. A coil terminal may be comprised of a conductive bracket that is secured within the insulated encasement using a screw. The screw and top portion of the conductive bracket may be accessible through the access port. The insulated encasement wraps around the top portion of the conductive bracket so that only the screw head is accessible through the access port. This serves to further isolate the coil terminal and limits the risk of unwanted arcing when a terminal is accessed for securing or adjusting a wire termination.

In another aspect of the invention, the primary housing may have insulated chambers that surround and isolate each of the terminals. The chambers may be comprised of non-conductive materials.

The primary housing may also include one or more wire ports to allow external access by conductive wire(s) so that the conductive wire may be connected to the respective coil terminals.

In another aspect of the invention, the primary housing may have four insulated coil terminal chambers. One coil terminal chamber may be used to house a positive (+) terminal. A second coil terminal chamber may be used to house a negative (−) terminal. A third coil terminal chamber may be used to house an ignition or spark terminal, e.g., the coil terminal for inducing a spark at the combustion site. A fourth coil terminal chamber may be used to house an ion terminal.

The addition of a fourth terminal provides for increased functionality and may be possible because of the reduced risk of arcing created by the coil housing of the present invention. Thus, the present invention may also provide an independent ion terminal separate from the ground terminal, which permits the coil system to have flame and/or spark detection functionality. In an embodiment of the present invention, the coil system includes flame or spark detection capability.

The previously described aspects of the invention have many advantages, including reducing unwanted arcing during coil maintenance, allowing more convenient placement of the coil, providing easier access for maintenance, facilitating the use of a fourth terminal, providing for flame and/or spark detection, and protecting the transformer coil and coil terminals from external agents that might cause unwanted arcing.

These and other aspects of the present invention are realized in a coil system and housing as shown and described in the following figures and related description.

BRIEF DESCRIPTION OF THE DRAWINGS

These and other features, aspects, and advantages of the present invention will become better understood with regard to the following description, appended claims, and accompanying drawings where:

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
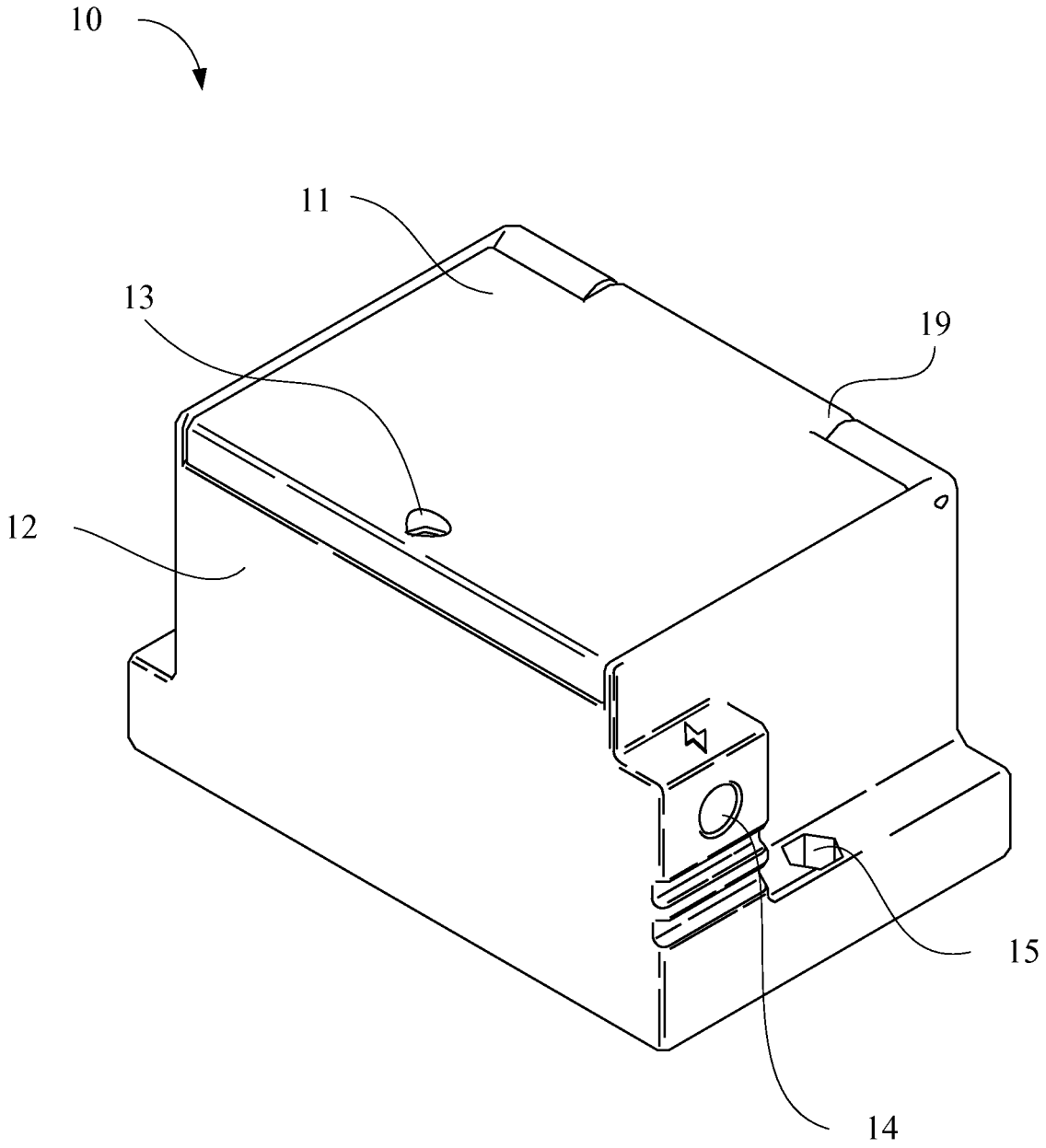
FIG. 1 shows a perspective view of a coil housing in accordance with the present invention.

Referring now to FIG. 1. a perspective view of a coil housing 10 for a coil system in accordance with the present invention is shown. As seen in FIG. 1, the coil housing 10 may comprise a housing lid 11 and a primary housing 12, wherein the housing lid 11 may be disposed on the primary housing 12. The housing lid 11 and the primary housing 12 may be made of any non-conductive material, including non-conductive plastics, polymers, or composite materials. The housing lid 11 and the primary housing 12 may be made using injection molding, machining, and any other methods commonly used by those skilled in the art for making articles of non-conductive material.

The housing lid 11 may include one or more housing lid securing holes 13 disposed therein configured for accepting a bolt or screw which may be inserted through the housing lid securing hole 13 and tightened into the primary housing 12 to secure the housing lid 11 to the primary housing 12. The housing lid 11 may be secured to the primary housing 12 using snap fastening components. Of course, one may also use any number of means or methods available to one skilled in the art for securing lids.

The housing lid 11 may also be rotatably attached to the primary housing 12 using one or more hinges 19. It should be understood that the housing lid 11 may also be attached to the primary housing 12 using any methods or means available to one skilled in the art that allows one to attach or remove, or to open or close, a lid.

As also seen in FIG. 1, the coil housing 10 may include a wire port 14 disposed in the primary housing 12 to provide access to a spark or ignition terminal for connecting a conductive wire to the spark/ignition terminal. The conductive wire may extend externally from the spark/ignition terminal to an electrode disposed at or near the situs where combustion or flame is to be initiated within the combustion management system. Thus, a transformer coil enclosed within the coil housing 10 may be used to produce high-voltage pulses which can be sent to the spark/ignition terminal and then through the conductive wire and to the electrode to create a spark and initiate combustion.

The primary housing 12 may also include additional wire ports to permit externally connecting conductive wire to each of the coil terminals of the coil system.

The primary housing 12 may also include mounting holes 15 which may be used in conjunction with screws or threaded mounting bolts to secure the coil housing 10 to a mounting surface where the coil system is to be positioned for use. The coil system may be secured in position by screwing screws or threading bolts through the mounting holes 15 and into the mounting surface. The coil housing 10 may also be secured to a mounting surface using an adhesive material to adhere the primary housing 12 to the mounting surface. Of course, the coil housing 10 may also be secured to a mounting surface using any number of methods or means available to one skilled in the art for mounting an object to a surface.

Figure 2:
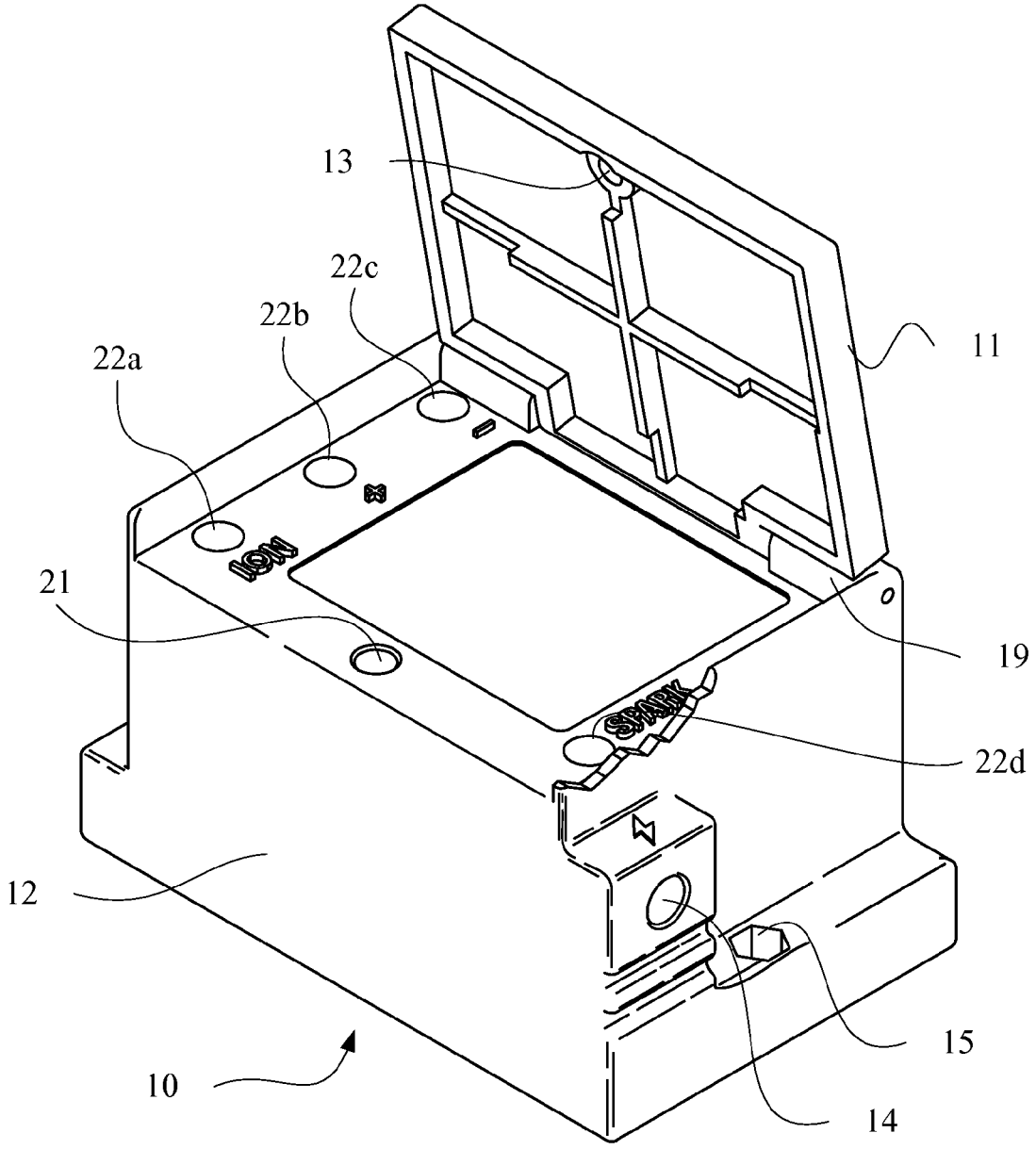
FIG. 2 shows a perspective view of a coil housing in accordance with the present invention with the housing lid in the open position and a partial cutaway view through a housing lid enclosure wall near the spark/ignition terminal.
Figure 3:
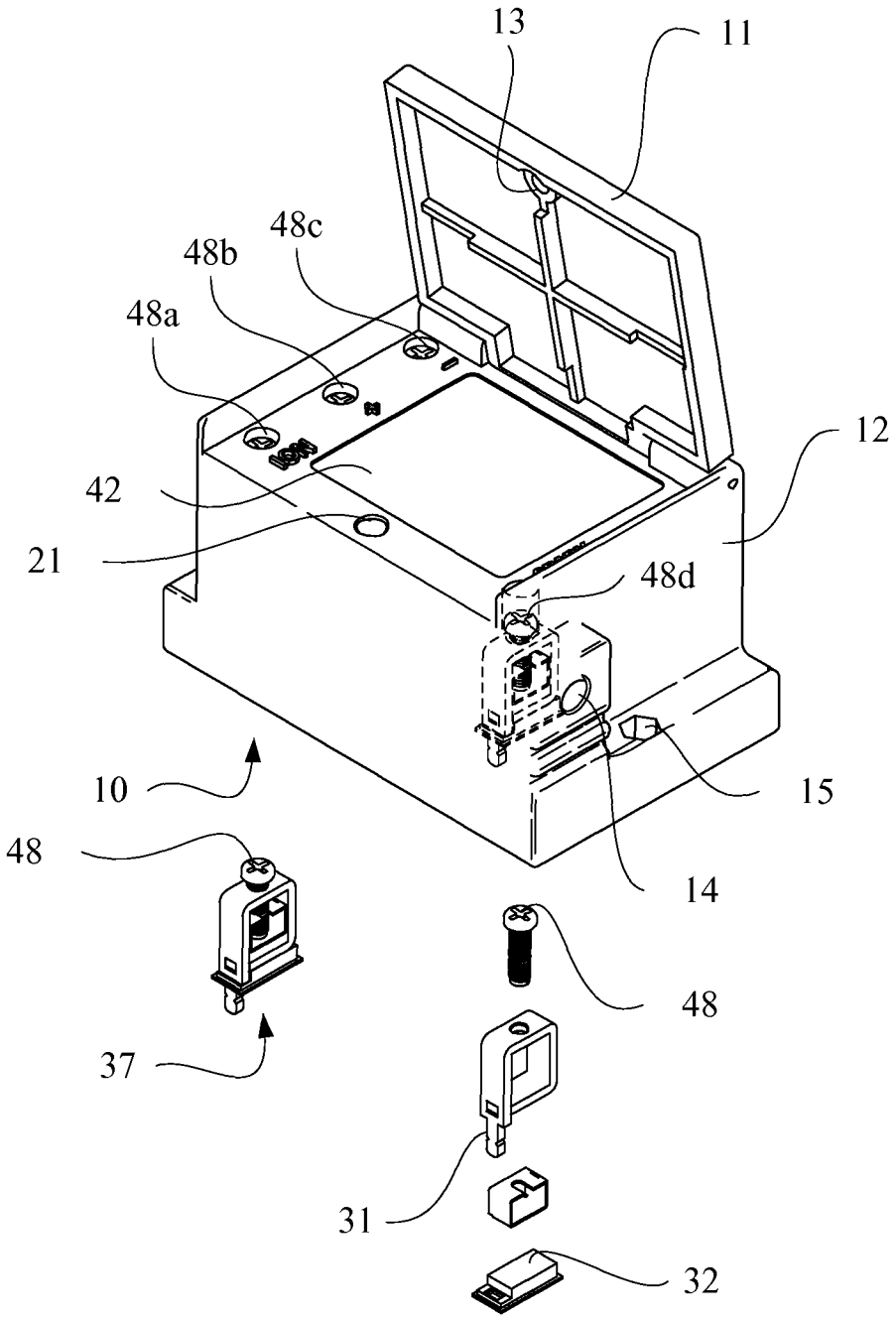
FIG. 3. shows a perspective view of coil system in accordance with the present invention with a partial transparent view showing placement of one of several conductive terminal bracket sets.

Reference will now be made to FIG. 2 and FIG. 3. Referring to FIG. 2, a perspective view of a coil housing 10 for a coil system in accordance with the present invention is shown with the housing 11 lid in an open position. Referring to FIG. 3, a perspective view of coil system in accordance with the present invention is shown with a partial transparent view of the coil housing 10 to show a terminal set 37 configured within the primary housing 12;

As can be seen from FIGS. 2 and 3, the coil housing 10 may also comprise four terminal recesses 22*a*, 22*b*, 22*c*, 22*d* that may be used as terminal access ports. The terminal recesses 22*a*, 22*b*, 22*c*, 22*d* may include an ion terminal recess 22*a*, a positive (+) terminal recess 22*b*, a negative (−) terminal recess 22*c*, and a spark terminal recess 22*d*. The terminal recesses 22*a*, 22*b*, 22*c*, 22*d* may permit access to the respective terminal sets 37 configured within the primary housing 12 below the terminal recesses 22*a*, 22*b*, 22*c*, 22*d*. The terminal recesses 22*a*, 22*b*, 22*c*, 22*d* allow for termination of the wires, while reducing the risk of unwanted contacts with the terminals and reducing exposure of the terminals to air. Terminal sets 37 may have a conductive bracket which may be tightened or loosened by inserting a screw driver into one of the terminal recesses and tightening or loosening a terminal set screw 48, permitting one to secure, loosen or otherwise adjust a conductive wire connection to the coil terminal.

The terminal set screws 48*a*, 48*b*, 48*c*, 48*d* may be configured within the terminal access port 22*a*, 22*b*, 22*c*, 22*d* below the outer surface of the primary housing 12 so as to not extend above the outer surface of the primary housing 12, thus, limiting exposure of the terminal sets to air and unwanted contacts. Having access to the terminals recessed within the primary housing, thus, also reduces the risk of arcing.

Figure 5:
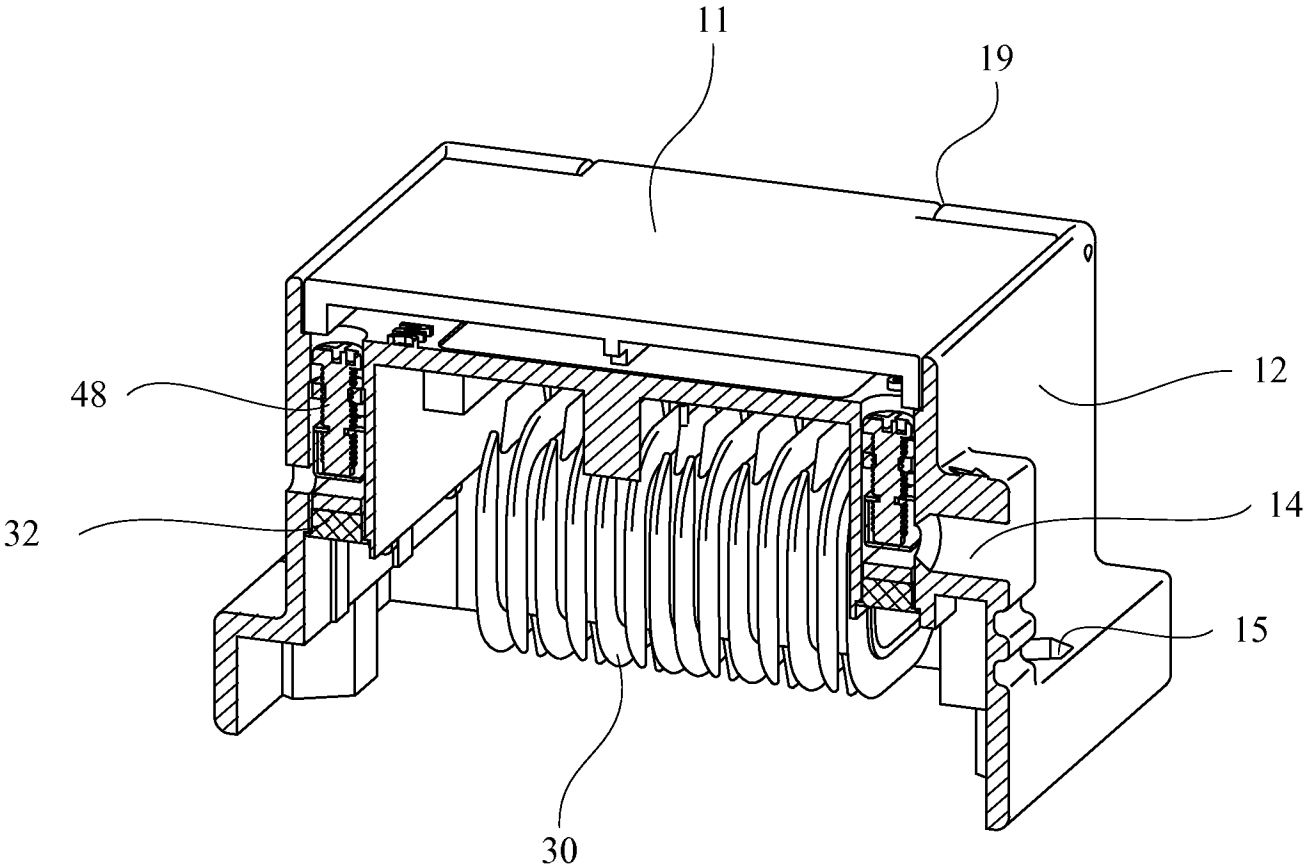
FIG. 5 shows a side cutaway view of a coil system in accordance with the present invention.

Exposure to air and unwanted contacts by the coil terminals may be further limited by positioning the housing lid 11 in a closed configuration. Thus, the housing lid 11 may be used to further reduce the risk of unwanted arcing, which allows coil terminals to be positioned closer to each without a dangerous risk of arcing. As shown in FIGS. 2 and 3, the housing lid 11 may include cross-section supports extending or protruding from the underside of the housing lid 11. The protruding cross-section supports on the underside of the housing lid 11 may also help separate air exposed to one coil terminal from air exposed to another coil terminal. As shown in FIG. 5, the cross-section supports of the housing lid 11 may engage the top side of the primary housing 12 to form compartments and help compartmentalize air and reduce arcing between terminal sets. The cross-section supports of the housing lid 11 may be disposed flush against the top side of the primary housing.

As may also be seen in FIGS. 2 and 3, the primary housing 12 may include housing lid enclosure walls which protrude from a plurality of the sides of the primary housing 12 beyond a top surface of the primary housing 12. As can be seen from FIGS. 1 and 5, the housing lid enclosure walls may engage the housing lid 11 when it is in the closed position to further reduce exposure of terminal sets to air and unwanted contacts. The housing lid enclosure walls may be laterally disposed to the housing lid 11 when it is in the closed position. The disposition of the housing lid enclosure walls with respect to the housing lid 11 may help further reduce the amount of air exposed to the coil terminals. The housing lid enclosure walls may also help support the housing lid 11 when it is in the closed position. The additional reduction of air exposure provided by the housing lid enclosure walls may also permit coil terminals to be positioned closer to each without a dangerous risk of arcing. As can also be seen from FIG. 5, the terminal recesses 22*a*, 22*b*, 22*c*, 22*d* may be closed by closing the housing lid 11 so that it engages the top side of the primary housing 12 to reduce exposure of the terminal sets to air and reduce the risk of unwanted arcing. As shown is FIG. 5, the housing lid 11 may engage the top side of the primary housing 12 so that at least a portion of the housing lid 11 is disposed flush against the top side of the primary housing 12 over at least a portion of the terminal recesses 22*a*, 22*b*, 22*c*, 22*d*.

The ability to position terminals closer to each other within a coil housing permits the addition of more coil terminals within a smaller coil housing and thus permits increased functionality within a smaller coil system without dangerously increasing the risk of arcing.

As can also be seen in FIGS. 2 and 3, the primary housing 12 may also include a threaded hole 21 for accepting a threaded bolt which can be threaded through the housing lid 11 for securing the housing lid 11 to the primary housing 12.

Figure 4:
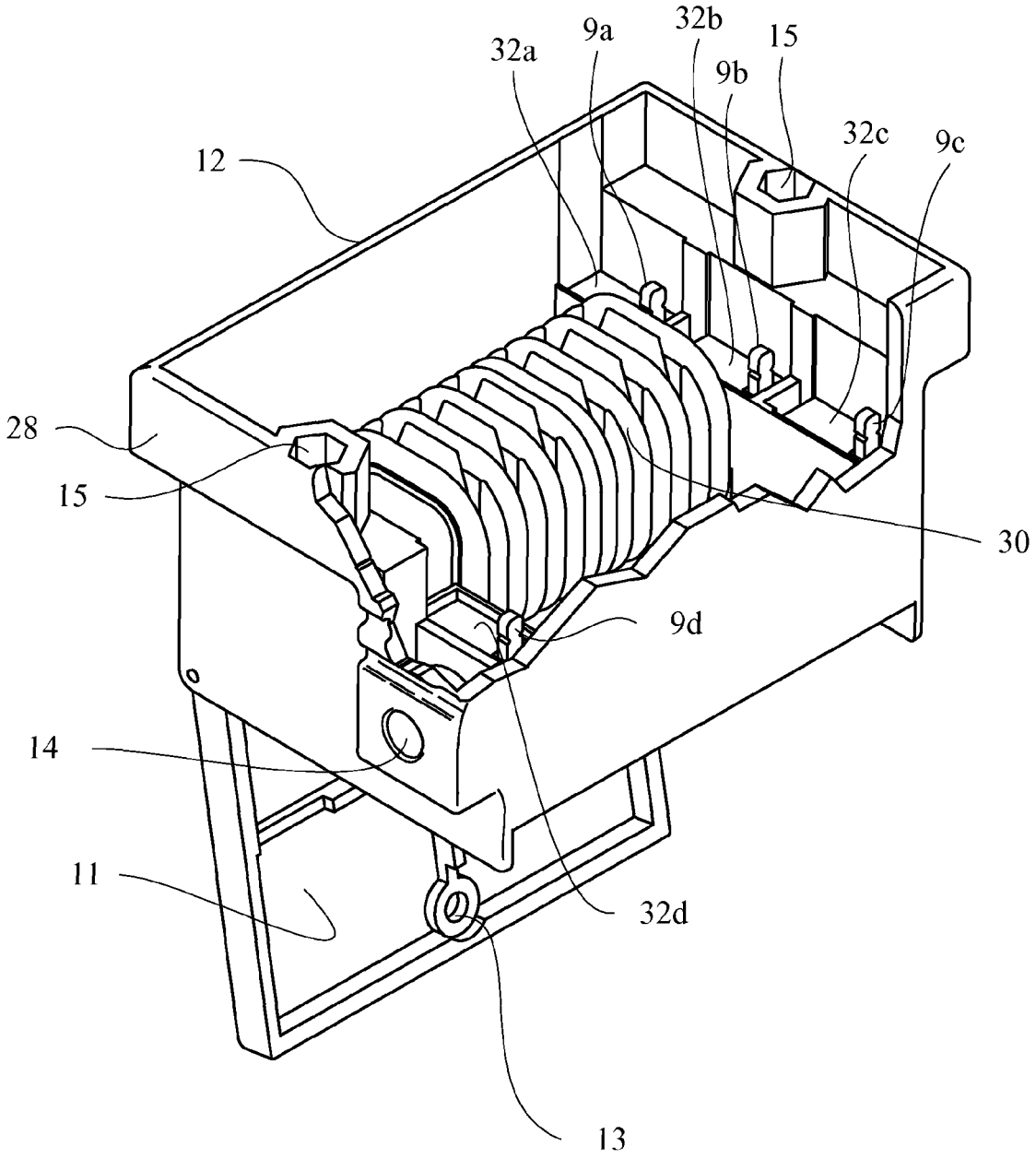
FIG. 4. shows a bottom perspective view of a coil system in accordance with the present invention with a partial cutaway view of the coil system.

Reference will now be made to FIG. 4 and FIG. 5. Referring to FIG. 4, a bottom perspective of a coil system in accordance with the present invention with a partial cutaway view of the coil housing 10 is shown. Referring to FIG. 5, a side cutaway view of a coil system in accordance with the present invention is shown.

As can be seen from FIGS. 4 and 5, a coil system of the present invention may include a coil housing having a primary housing 12 and a transformer coil 30 enclosed within the primary housing 12. The transformer coil 30 may include an input coil and an output coil. The transformer coil 30 may be connected to one or more coil terminals disposed in the coil housing 10. A coil terminal may be comprised of a coil terminal set 37.

Preferably, a plurality of coil terminal sets 37 may be disposed in insulated chambers within the primary housing 12. In one embodiment of the present invention, there may be four coil terminals disposed in coil housing 10. The coil terminals may include an ion terminal, a positive (+) terminal, a negative (−) terminal, and a spark terminal. The positive (+) terminal and the negative (−) terminal may be connected to the input coil and the ion terminal and the spark terminal may be connected to the output coil.

The terminal sets 37 comprising the ion terminal, the positive (+) terminal, the negative (−) terminal, and the spark terminal may be secured in the insulated chambers using non-conductive caps or cover plates 32*a*, 32*b*, 32*c*, 32*d*. The cover plates 32*a*, 32*b*, 32*c*, 32*d* may snap into the ends of the insulated chambers to secure the respective coil terminals in the insulated terminal chambers.

The non-conductive cover plates 32*a*, 32*b*, 32*c*, 32*d* may be configured to permit soldering terminals 9*a*, 9*b*, 9*c*, 9*d* to extend from the respective terminal brackets through the cover plates 32*a*, 32*b*, 32*c*, 32*d* as shown in FIG. 4. The non-conductive cover plates 32*a*, 32*b*, 32*c*, 32*d* further insulate the respective coil terminals and may prevent epoxy from coming into contact with the terminals when sealing the bottom of the coil housing using an epoxy potting process. The soldering terminals 9*a*, 9*b*, 9*c*, 9*d* may be used to configure the wiring within the coil system and permits electrical wire to be connected to the respective coil terminals so that one may electrically connect the respective coil terminals with other components of the coil system as desired. Typically, wire may be connected from the respective soldering terminals 9*a*, 9*b*, 9*c*, 9*d* to the input coil and the output coil so that the positive (+) terminal and the negative (−) terminal may be connected to the input coil and the ion terminal the spark terminal may be connected to the output coil. Wire may be connected to the coil terminals at the soldering terminals 9*a*, 9*b*, 9*c*, 9*d* using solder. It should be understood that conductive wire may also be connected to the coil terminals and the input and output coils using any methods or means available to one skilled in the art for connecting wire between a coil terminal and a transformer coil.

After the conductive wire has been configured to connect the transformer coil 30 to respective coil terminals within the primary housing 12 as desired, epoxy may be poured into the bottom of the primary housing 12 to seal the bottom of the primary housing 12 using an epoxy potting process, which may insulate the wires, the soldering terminals 9*a*, 9*b*, 9*c*, 9*d* and the connection points between the wires and the transformer coil. The epoxy potting process involves baking the epoxy in an oven to accelerate curing. Sealing the bottom of the primary housing using an epoxy potting process may also limit the coil terminals and other electrical components' exposure to air and moisture, and reduce the risk of arcing or unwanted contacts with electrical contact points.

As can also be seen from FIG. 5, the primary housing may also include a wire port for each of the coil terminals to permit connecting an external wire to each of the respective coil terminals. Thus, a coil system in accordance with the present invention having four coil terminals may also have four wire ports.

There is thus disclosed an improved coil system and housing. It will be appreciated that numerous changes may be made to the present invention without departing from the scope of the claims.

What is claimed is:

1. A coil system for initiating combustion in a combustion management system comprising:

A primary housing wherein three or more terminal access ports are disposed in the primary housing;

A housing lid removably attached to the primary housing wherein the housing lid is configured to cover a plurality of the three or more terminal access ports when the housing lid is in a closed position and wherein the housing lid is configured to engage a terminal recess side of the primary housing so that at least a portion of the housing lid is disposed flush against the terminal recess side of the primary housing over at least a portion of the terminal recesses;

A transformer coil disposed inside the primary housing; and

Three or more coil terminals disposed in the primary housing respectively below each of the three or more terminal access ports wherein at least one of the three or more coil terminals may be accessed through at least one of the three or more terminal access ports.

2. The coil system of claim 1, wherein the three or more coil terminals comprise at least four coil terminals.

3. The coil system of claim 2, wherein the at least four coil terminals comprise a positive (+) terminal, a negative (−) terminal, an ion terminal, and a spark terminal.

4. Original) The coil system of claim 1, wherein the housing lid is rotatably attached to the primary housing using one or more hinges.

5. The coil system of claim 1, wherein the primary housing further includes at least one wire port disposed therein which is configured to permit access by an external wire to a coil terminal.

6. The coil system of claim 5, wherein the wire port disposed in the primary housing is configured to permit connection of an external wire to a spark terminal.

7. The coil system of claim 1, wherein the housing lid and the primary housing are comprised of a non-conductive material.

8. The coil system of claim 7, wherein the non-conductive material is plastic.

9. The coil system of claim 7, wherein the non-conductive material is epoxy.

10. The coil system of claim 1, wherein the housing lid further comprises a plurality of housing lid supports protruding from an underside of the housing lid and wherein the plurality of housing lid supports form a plurality of compartments when the housing lid is in a closed position.

11. The coil system of claim 4, wherein the housing lid further comprises at least one wall protruding from a plurality of the sides of the primary housing and wherein the housing lid and the primary housing are configured so that the at least one wall protruding from a plurality of the sides of the primary housing is laterally disposed to the housing lid when the housing lid is in a closed position.

12. The coil system of claim 6, further comprising a conductive wire extending externally from the spark terminal to an electrode disposed adjacent to a combustion site.

13. A coil system comprising:

A primary housing including at least one wall protruding from a plurality of the sides of the primary housing and wherein a plurality of terminal access ports are disposed in the primary housing;

A housing lid removably attached to the primary housing wherein the housing lid and the primary housing are configured so that the at least one wall protruding from a plurality of the sides of the primary housing is laterally disposed to the housing lid when the housing lid is in a closed position;

A transformer coil disposed inside the primary housing; and

A plurality of coil terminals disposed in the primary housing respectively below each of the plurality of terminal access ports wherein at least one of the plurality of coil terminals may be accessed through at least one of the plurality of terminal access ports.

14. The coil system of claim 13, wherein the housing lid removably attached to the primary housing is configured to cover a plurality of the terminal access ports when the housing lid is in a closed position.

15. The coil system of claim 13, wherein the plurality of coil terminals comprise a positive (+) terminal, a negative (−) terminal, an ion terminal, and a spark terminal.

16. The coil system of claim 13, wherein at least one wire port is disposed in the primary housing and is configured to permit access by an external wire.

17. The coil system of claim 16, further comprising a conductive wire extending externally from a spark terminal to an electrode disposed adjacent to a combustion site.

18. The coil system of claim 13, wherein the housing lid is configured to engage the primary housing so that at least a portion of the housing lid is disposed flush against a terminal recess side of the primary housing over at least a portion of the plurality of terminal recesses.

19. The coil system of claim 13, wherein the housing lid further comprises a plurality of housing lid supports protruding from an underside of the housing lid and wherein the plurality of housing lid supports form a plurality of compartments when the housing lid is in a closed position.

* * * * *